US005139189A

United States Patent [19]

Hanley

[11] Patent Number: 5,139,189

[45] Date of Patent: Aug. 18, 1992

[54] RESERVE BALL HOLDER

[76] Inventor: James J. Hanley, 106 Mariner Dr., Ormond By The Sea, Fla. 32176

[21] Appl. No.: 737,315

[22] Filed: Jul. 29, 1991

[51] Int. Cl.[5] ..... A45F 5/02

[52] U.S. Cl. ..... 224/252; 224/253; 224/919; 206/315.9

[58] Field of Search ..... 224/252, 253, 919, 918; 206/315.9; 211/14; 273/29 R, 32 D

[56] References Cited

U.S. PATENT DOCUMENTS

| | | | |
|---|---|---|---|
| 3,968,875 | 7/1976 | Koehnle | 211/14 X |
| 4,042,156 | 8/1977 | Knight | 224/253 |
| 4,062,482 | 12/1977 | Szalony | 224/252 X |
| 4,269,338 | 5/1981 | Sichel | 224/252 X |
| 4,299,345 | 11/1981 | Lanzl | 224/252 |
| 4,396,136 | 8/1983 | Stafford, Jr. | 224/919 X |
| 4,416,404 | 11/1983 | Daniels | 224/224 |
| 4,840,332 | 6/1989 | Hoyt | 224/251 X |
| 5,064,107 | 11/1991 | Ascarrunz | 224/253 X |

*Primary Examiner*—Henry J. Recla
*Assistant Examiner*—Glenn T. Barrett

[57] ABSTRACT

A novel one piece reserve ball holder having an integral device for attachment to a player's waistband or belt comprising a right cylinder structure having an interior diameter minimally smaller than that of a tennis ball, and long enough to accept and hold firmly two tennis balls, which while protruding one from each end are contained by the ball's inflated pressure and the binding friction and resistance to movement that occurs where the ball's outer surface comes into contact with the interior wall surface of the cylinder which is divided by a partition at the center of its length into two separate chambers each having a depth slightly greater than the ball's radius dimension and each chamber having near its open end in the sides of the tube two axially aligned openings of a length and width approximately half the ball's radius dimension to allow digital access for placing and removing the ball or balls from the holder.

3 Claims, 2 Drawing Sheets

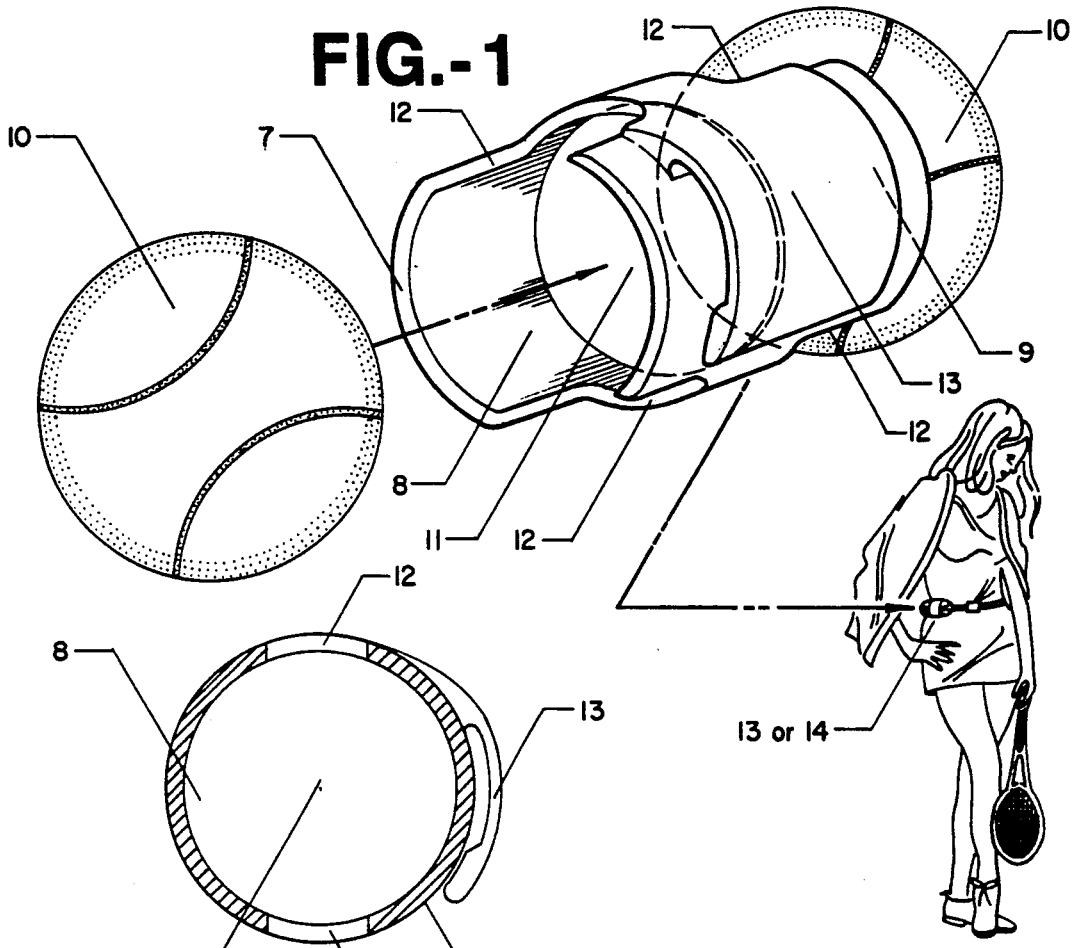
FIG.-1
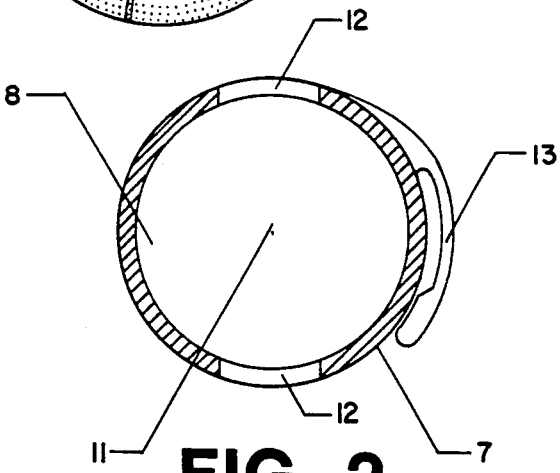
FIG.-2
FIG.-3
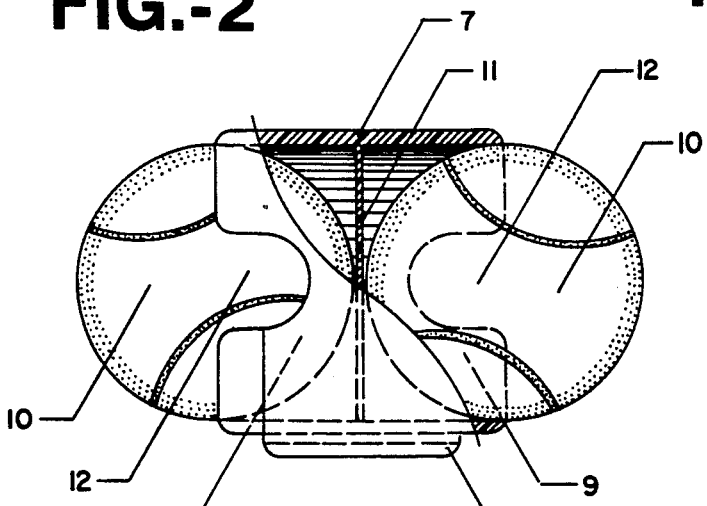
FIG.-4

RESERVE BALL HOLDER

BACKGROUND OF THE INVENTION

1. Field of the Invention

The present invention refers to portable, light weight, ball carrying devices adapted to be comfortably worn by a player while playing tennis or other games requiring as a prerequisite to uninterrupted play, the periodic rapid substitution of additional balls to replace those going out of play.

In particular, the present invention relates to a one piece hollow right cylinder device for holding in reserve one or two balls and having an integral device for attachment to a belt or waistband of a player.

2. Prior Art

It is difficult to over-emphasize the deleterious effect which results from repeated interruptions when they occur during the play of the game of tennis, which after all is to a large degree for those who so pursue it, a serious sport requiring no small amount of perseverance and concentration. Therefore anything that contributes to reducing interruptions i.e. distractions from concentration contributes to the improvement of the game. The interruptions that I address here are those caused by balls going out of bounds out of play or out of reach, and the immediate need for a reserve of replacement balls.

Portable ball holders and carriers are known in configurations of tubes, cup-shapes, wire-forms, cones, pockets and clips.

U.S. Pat. No. 4,042,156 describes a tubular structure of a larger diameter than a ball utilizing foam or springs to press ball against a retaining lip.

An alternative embodiment depicts a hollow tube containing a pair of semispherical cups each lined at the bottom with fabric such as Velcro hook pad. This Velcro hook pad is a device for preventing the ball from falling out of the cup.

Another embodiment of the same invention features truncated conical members joined by a band. The perimeter of the mouth is slightly smaller than the circumference of a tennis ball. U.S. Pat. No. 4,062,482 describes a one piece clip type carrier for balancing balls in a holding position while attached to a player's garment. U.S. Pat. No. 4,396,136 describes a belt with hemispherical units having internally projecting ribs which provide a grasping hold on an inserted ball. U.S. Pat. No. 4,433,803 describes a belt with elastic pockets for containing balls. U.S. Pat. No. 4,781,307 is for a ball dispenser of elongated open end tubular structure for containing and dispensing balls by means of a finger operable dispenser mechanism. U.S. Pat. No. 4,849,332 is for an open-ended tubular member with an end to end elongated aperature and resilient outwardly expandable walls having a stop member at one end and a clip at the other.

In summary, prior art teaches the use of triggers, stops, springs, Velcro hook pad, foam pad, lips, belts, pockets and cones etc. These features often proved awkward, and cumbersome, adding weight and size to those referred to embodiments. The present invention eliminates the need for these superflous cumbersome features and provides a suitable device with minimum number of parts.

SUMMARY OF INVENTION

The present invention provides a compact, portable hollow right cylinder ball holder of a one piece construction which may be attached to and removed from a player's belt or waistband.

It holds one or two balls securely in a convenient position for easy and rapid access. More particularly the present invention provides a hollow right cylinder device with a diameter slightly smaller than the ball being held, and long enough to accept and hold firmly two tennis balls, which while protuding one from each end are contained by the balls inflated pressure and the binding and friction, and resistance to movement that occurs, where the balls contact the interior walls of the cylinder. At the center of the cylinder's length, there is a flat surfaced thin barrier, partition which divides the cylinder into two chambers. This partition prevents either ball from entering the respective chamber more than is necessary to be firmly held. It may be molded from plastic or aluminum, or formulated from other light weight durable, resilient material. To further describe this invention, it is constructed with an integral device for attaching to and removing from a player's belt or waistband. And the sides of the cylinder near each of the open ends of the chambers are designed with axially oriented openings to allow digital access for the placement and removal of the balls. The primary object of the present invention is to provide a compact portable, durable, light-weight, ball holder of a one-piece construction which may be molded from plastic or aluminum, or formulated from other light weight durable, resilient material.

Another object of the present invention is to provide a reserve ball holder which allows the player to rotate the use of the balls, normally a set of three, thus balance out and make even the wear factor to assure more uniform predictability during play.

Another object is to provide a reserve ball holder which is easy to make and affordable by all.

Another object is to provide a ball holder which may become standard equipment for many tennis players and others using reserve or replacement balls.

Another object of the present invention is to improve the quality of play in tennis and other games requiring reserve or replacement balls by reducing the distractions players must suffer while seeking out and finding balls to replace a first or second ball served, which has gone out of play, or over the fence, thus interrupting the service and the play of the game until a replacement is found.

Additional details, objects, and advantages will become apparent in the following descriptions, drawings, and claims.

BRIEF DESCRIPTION OF DRAWINGS

FIG. 1 Is a perspective view of one embodiment of the present invention showing a portable hollow right cylinder ball holder for one or two balls comprising an integral device for conveniently attaching to and removing from a player's belt or waistband.

FIG. 2 Is an end elevational view of the embodiment shown in FIG. 1.

FIG. 3 Shows the embodiment of FIG. 1 or the embodiment of FIG. 5 as worn for use by player.

FIG. 4 Is a top plan view of embodiments shown in FIG. 1 and FIG. 5.

DETAILED DESCRIPTIONS OF SOME PREFERRED EMBODIMENTS OF THE PRESENT INVENTION

Figure 5:
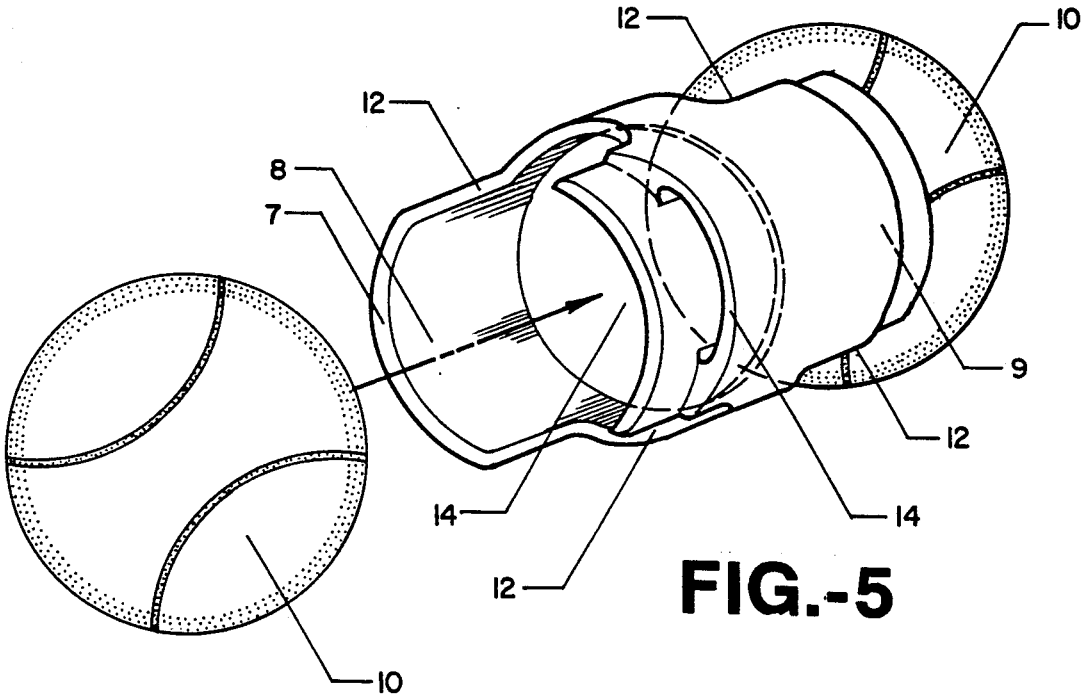
FIG. 5 Is a perspective view of a second embodiment of the present invention showing a portable hollow right cylinder ball holder for one or two balls comprising an integral device for conveniently attaching to and removing from a player's belt.

With reference to FIGS. 1 and 2 there is shown one embodiment of the present invention a hollow right cylinder one-piece structure 7 of a uniform diameter minimally smaller than that of a tennis ball 10 comprising a center partition 11 which divides the cylinder's length into 2 equal open-end chambers 8 and 9, into and out of which a tennis ball 10 may be moved with little effort, side openings 12 axially oriented at the open ends of each of the chambers 8 and 9, and a device 13 for quick attachment to belt or waistband.

FIG. 3 Shows a person wearing either of the two embodiments shown in FIG. 1 and FIG. 5.

In FIG. 4 The center partition 11 can be seen as dividing the cylinder structure 7 into two equally apportioned open-ended chambers 8 and 9. The walls of each of the chambers at the open ends are designed with axially oriented openings 12 to allow digital access for rapid placement or removal of the balls 10.

Figure 6:
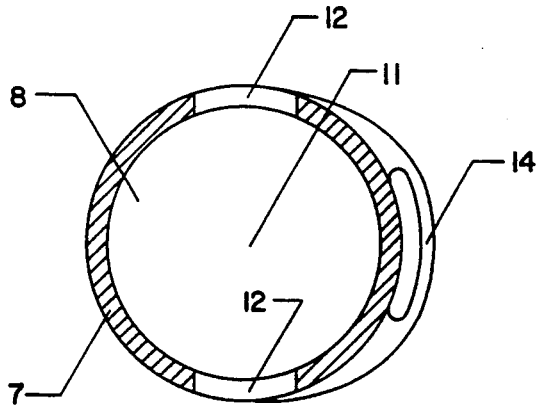
FIG. 6 Is an end elevational view of the embodiment shown in FIG. 5.

FIG. 5 and FIG. 6 show a second embodiment of the present invention comprising a device for easy attachment to a belt.

Comparing FIGS. 1 and 2 with FIGS. 5 and 6 one quickly discerns a marked difference between the device of FIGS. 1 and 2 having one end integrally connected and one end open to facilitate instant attachment to a belt or waistband of skirt, shorts, or trousers; and the device of FIGS. 5 and 6 having both ends integrally connected for easy attachment to a belt.

I have here provided a full and complete disclosure of the preferred embodiment of the invention. However, modifications may be made and alternate embodiments result as desired by those skilled in the art without departing from the scope, spirit and intent and essential characteristics of the present invention. Accordingly the above descriptions, drawings and embodiments are intended to be illustrative and not limiting to the scope of the invention defined in the appended claims.

I claim:

1. A one piece ball holder adapted for readily removably holding at least one ball having a diameter, an outer surface, and an inflated pressure while attached to the person of a player, said ball holder comprising: a right cylinder structure having a pair of open ends, an interior diameter minimally smaller than the diameter of a tennis ball and a length adapted to accept and hold firmly two balls such that a ball protrudes from each end of said holder and is contained therein by the inflated pressure of the ball and a binding friction and resistance to movement that occurs when the outer surface of the ball comes into contact with the interior of the cylinder, said cylinder having a partition located at a center of its length dividing said cylinder into two separate chambers each having a depth slightly greater than the radius of the ball and each chamber having near said open end in the cylinder two axially aligned openings of a length and width approximately half the radius of the ball to allow digital access for placing and removing the ball or balls from the holder; and means for attaching said hollow right cylinder structure to a person.

2. A ball holder characterized substantially in accordance with claim 1, wherein said means for attaching includes an integral device for attaching to and removing from a player's belt or waistband.

3. A ball holder characterized substantially in accordance with claim 1, wherein said means for attaching includes an integral device for attaching to and removing from a player's belt.

* * * * *